United States Patent [19]

Zodrow et al.

[11] Patent Number: 4,692,201

[45] Date of Patent: Sep. 8, 1987

[54] SMOOTHING AND PRESSING DOWN DEVICE IN LABELING MACHINES

[75] Inventors: Rudolf Zodrow, Dusseldorf; Josef Tomashauser, Willich, both of Fed. Rep. of Germany

[73] Assignee: Jagenberg Aktiengesellschaft, Dusseldorf, Fed. Rep. of Germany

[21] Appl. No.: 733,440

[22] Filed: May 13, 1985

[30] Foreign Application Priority Data

May 12, 1984 [DE] Fed. Rep. of Germany ..... 3417
Oct. 11, 1984 [DE] Fed. Rep. of Germany ..... 3417283

[51] Int. Cl.[4] ..... B65C 3/22; B65C 9/34

[52] U.S. Cl. ..... 156/488; 53/49; 53/362; 156/493; 156/DIG. 16; 156/DIG. 42

[58] Field of Search ..... 156/212, 213, 488, 486, 156/493, 581, DIG. 14, DIG. 15, DIG. 16, DIG. 42, 423, 583.3; 53/344, 345, 346, 357, 358, 360, 361, 362, 49

[56] References Cited

U.S. PATENT DOCUMENTS 2,193,618 3/1940 Carter ..... 53/361
2,297,720 10/1942 Schmutzer ..... 156/DIG. 16
3,073,088 1/1963 White ..... 53/361
4,297,161 10/1981 Graffin ..... 156/583.3

FOREIGN PATENT DOCUMENTS 2432474 2/1978 France ..... 53/357

*Primary Examiner*—Michael Wityshyn
*Assistant Examiner*—J. Davis
*Attorney, Agent, or Firm*—Sprung, Horn, Kramer & Woods

[57] ABSTRACT

A device for smoothing and pressing down in labeling machines, intended for the point of a blank of foil wrapped around the neck and head of a bottle with the point projecting at the head, and having a pot-like housing that can be moved axially against the head of the bottle and accommodates an elastic sponge structure. To allow the device to handle the blank of foil gently, apply it uniform and smooth to the head of bottle even in the vicinity of depressed zones of the head, and to prolong its life, the face of the sponge structure toward the head of the bottle has a recess that in the pressing-down position embraces at least the head of the bottle on all sides subject to slight tension.

7 Claims, 4 Drawing Figures

SMOOTHING AND PRESSING DOWN DEVICE IN LABELING MACHINES

BACKGROUND OF THE INVENTION

The present invention relates to a device for smoothing and pressing down foil on bottles in labeling machines and is intended for the point of a blank of foil wrapped around the neck and head of a bottle with the point projecting at the head, and has a pot-like housing that can be moved axially against the head of the bottle and accommodates an elastic sponge structure.

In applying foil to bottles it is the smoothing of the projecting point of the blank of foil, that is wrapped especially against the face of the bottle head, that causes the most trouble because of the difficulty of uniformly distributing the resulting pile-up of material while completely covering the head and extensively protecting the sensitive foil. The difficulty increases with the increasing output of the labeling machine.

There has been no lack of attempts to solve the problem. German Patent No. 964 126 for example discloses a smoothing and pressing-down device that has a central component consisting of a resiliently supported die accommodated in a guide and an annular outer component consisting of a spiral ring in an axially stationary retainer that allows it to move only radially. Once the smoothing and pressing-down device drops onto the head of the bottle, the spiral ring rolls along the circumference of the bottle towards its axis while the die retreats. This presses the projecting and wrapped point of the foil blank against the head of the bottle and the sides of the blank against the bottle. Since the cross-section of the spiral ring does not allow it to match the curve of the bottle satisfactorily, the blank cannot be satisfactorily smoothed, and wrinkles in the vicinity of the bottle head. Furthermore, the foil is stressed to such an extent by the spiral ring as it travels axially over the bottle that damage to the foil must be taken into account.

Again, U.S. Pat. No. 2,297,720 discloses a tulip-shaped smoothing and pressing-down device made out of a resilient material that applies the blank in the vicinity of the head and neck of the bottle. When the rubber tulip is not subject to stress, its inside diameter is longer than the diameter of the head and neck of the bottle. When the head of the bottle enters the tulip structure, the blank of foil is applied to the head and neck as the walls of the structure stretch. The application of hydraulic pressure to the outside of the tulip structure is unavoidable in order to make the radial force uniform enough to ensure unexceptionable application of the blank to the bottle. Attempts to do without it and to apply and smooth the blank through the expansion of the resilient material alone have not resulted in satisfactory application and such a solution has not turned out to be practical.

Again, smoothing and pressing down the blank with a system of brushes entails the drawbacks that the bottle absolutely must be rotated, that smoothing and brushing on cannot be controlled, and that wear is very high.

SUMMARY OF THE INVENTION

The object of the present invention is to provide a smoothing and pressing down device in labeling machines that is intended for the point of a blank of foil wrapped around the neck and head of a bottle with the point projecting at the head, that will handle the blank of foil gently, that will apply it uniformly and smoothly to the head of bottle even in the vicinity of depressed zones of the head, and that will be distinguished for long life.

This object is attained in accordance with the invention in that the face of the sponge structure toward the head of the bottle has a recess that in the pressing-down position embraces at least the head of the bottle on all sides subject to slight tension.

The design in accordance with the invention results in an inexpensive smoothing and pressing-down device that will press down the blank of foil smoothly and uniformly in the vicinity of the head and upper part of the neck, with the foil being handled extremely gently. It turns out that the blank will be applied satisfactorily and smoothly even in the depressed zones of the head and that the tension necessary to apply the blank smoothly will not displace it when the smoothing and pressing-down device is raised again.

The tension can of course be adjusted as desired to the particular size of the bottle and to the type of foil employed.

It has turned out to be practical for the recess to have a smooth surface and to be essentially cylindrical. It is also practical for the inner edges of the depression that face the head of the bottle to be rounded off or beveled.

To make it possible to adapt to given conditions even more precisely. the recess can be surrounded by at least one incision, preferably in the form of an annular channel. The recess and annular channel will preferably be more or less equal in depth, extending into the housing and beyond its face to about $\frac{1}{3}$ of their depth and with about $\frac{2}{3}$ extending outside of housing.

To prevent suction between the recess and the head of the bottle when the smoothing and pressing down device is raised, the recess communicates with a relaxation space inside the sponge structure through an air-escape aperture.

In one embodiment of the invention the sponge structure consists of at least two horizontally separate components, one an insert structure that rests against the housing and can be compressed axially and the other a multilayer pressing-down structure that contains the recess embracing the head of the bottle. This embodiment presses the point of the blank down better and results in a longer-lived smoothing and pressing-down device.

The multilayer pressing-down structure consists preferably of several flat pressing-down disks, which can be stamped out very economically.

The pressing-down disks are in a practical way mounted with axial and radial play in a retainer that has an aperture to admit the head of the bottle and an annular pressure surface with rounded or beveled forward edges. The difference between the diameter of the pressure surface and that of the head of the bottle is less than the thickness of the package of pressing-down disks. This makes it possible to prescribe the pressure around the total head of the bottle precisely at a low pressure build-up and thus ensure that the blank or its point will be pressed down satisfactorily. The stacking of the disks will increase the area of pressure, especially toward the lower part of the bottle neck, without a lot of squeezing and tensioning in the disks while allowing the necessary pressure to be kept low.

This behavior can be improved even more if the retainer and a pressure plate that is part of an insert in the insert structure are made out of or coated with a slippery material such as polytetrafluoroethylene.

Some preferred embodiments of the invention will now be described with reference to the attached drawings, wherein:

DETAILED DESCRIPTION OF THE PREFERRED EMBODIMENTS

Figure 1:
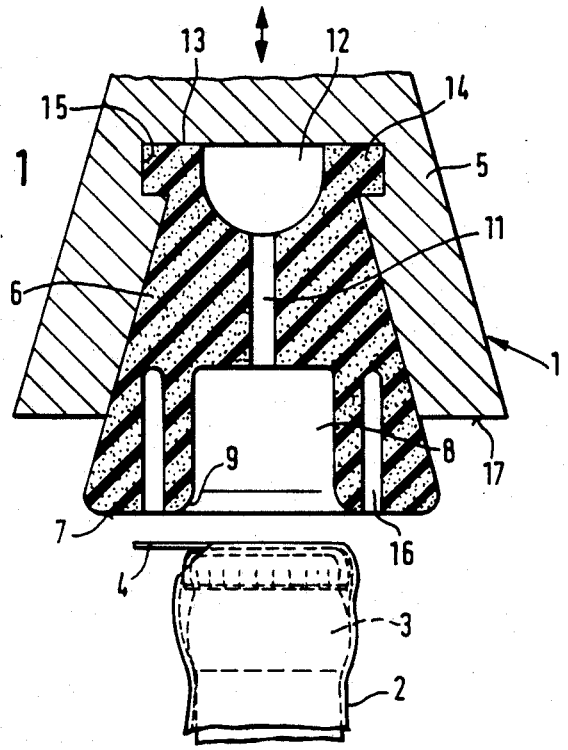
FIG. 1 is a sectional view of one embodiment of a smoothing and pressing-down device in accordance with the invention in the out-of-action position.
Figure 2:
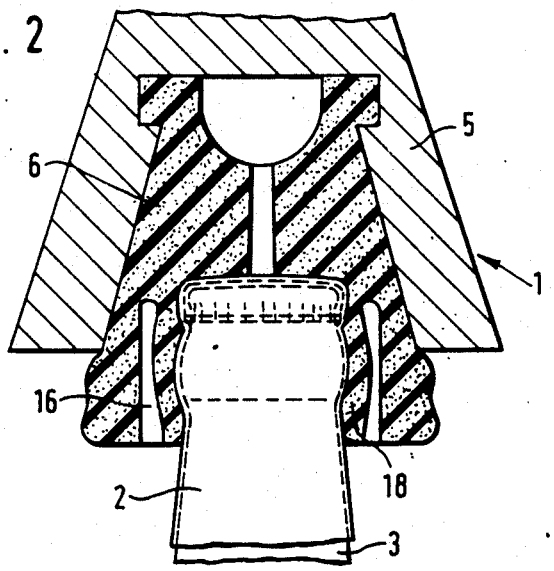
FIG. 2 is a sectional view of the device of FIG. 1 in the pressing-down position.

Smoothing and pressing-down devices 1 of the type illustrated in FIGS. 1 and 2 are positioned in the vicinity of the out-take star, not illustrated, of a labeling machine. Each smoothing and pressing-down device 1 can be moved up to a bottle 3 that has been provided with a blank 2 of foil in order to smooth the blank and a point 4 on the blank that projects at the face of the bottle head and to press them down against the head and upper part of the neck on all sides as will be explained later herein with reference to FIG. 2.

Smoothing and pressing-down device 1 has a pot-like housing 5 that accommodates a sponge structure 6.

Sponge structure 6 is basically in the shape of a truncated cone and the face 7 toward the head of bottle 3 has a central cylindrical recess 8. The edges 9 of the side of recess 8 toward face 7 are rounded or beveled. Sponge structure 6 communicates in the vicinity of recess 8 with a relaxation space 12 through an air-escape aprture 11. Relaxation space 12 can be placed in communication with an air-escape channel, not illustrated, in housing 5. The face 13 of sponge structure 6 that is remote from face 7 has an outside flange 14 that engages a matching annular groove 15 in housing 5.

An annular channel 16 approximately as deep as recess 8 is positioned in sponge structure 6 in the vicinity of and at a certain distance from the recess. Both recess 8 and annular channel 16 penetrate into housing 5 beyond its lower face 17 to about $\frac{1}{3}$ of their depth, leaving about 170 of their depth outside.

The diameter of recess 8 is long enough to generate a slight tension when smoothing and pressing-down device 1 cups a foiled bottle 3.

The operation of smoothing and pressing-down device 1 will now be described.

When a bottle 3 enters the transfer star of the labeling machine with the point 4 of foil blank 2 standing out upstream, smoothing and pressing-down device 1 swings forward to above the bottle, with the point being wrapped flat against the face of the bottle if necessary by the smoothing and pressing-down device itself. Smoothing and pressing-down device 1 continues moving until its axis coincides with that of the bottle. With the bottle thus prepared, the device then drops down onto it. The recess 8 in sponge structure 6 surrounds the head and upper part of the neck of the bottle while maintaining a certain amount of tension, pressing foil blank 2 along with its projecting point 4 uniformly and smoothly against the bottle as illustrated in FIG. 2. The wall 18 between recess 8 and annular channel 16 adjusts to the contour of the head and upper part of the neck. Since the inner surface of recess 8 is very smooth, it will not affect or displace foil blank 2 as it moves up again. This careful treatment of blank 2 and of smoothing and pressing-down device 1 itself results in a very long life for the latter.

Figure 3:
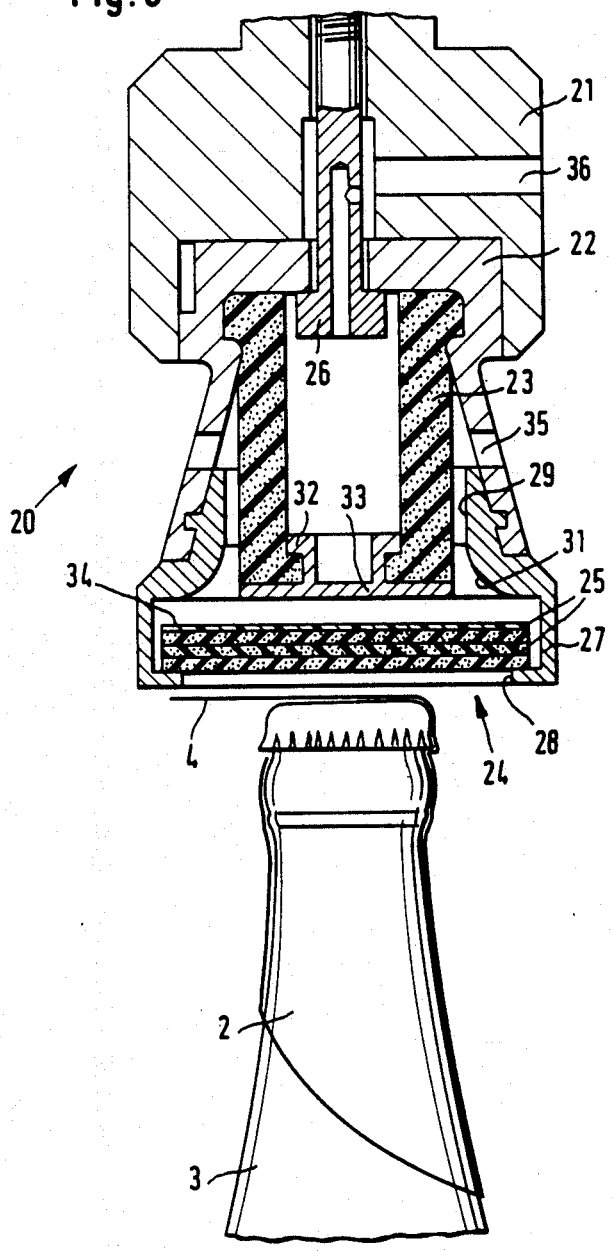
FIG. 3 is a sectional view of another embodiment in the out-of-action position.
Figure 4:
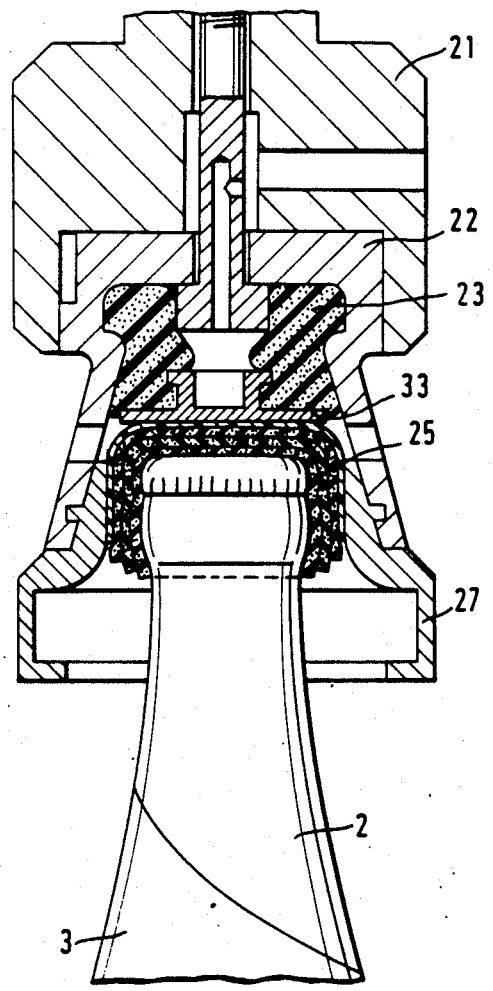
FIG. 4 is a sectional view of the device of FIG. 3 in the pressing-down position.

The sponge structure in the smoothing and pressing-down device 20 illustrated in FIGS. 3 and 4 consists of two horizontally separate components, one an insert structure 23 that rests in an accommodation piece 22 against the housing 21 and the other, facing bottle 3, a multilayer pressing-down structure 24 in the form of several flat pressing-down disks 25. Accommodation piece 22, which is fastened to a housing 21 by means of a screw 26, is conical and has at the end remote from housing 21 a retainer 27 that accepts pressing-down disks 25 with axial and radial play. Retainer 27 has an aperture 28 for the head of bottle 3 to pass through and an annular pressure surface 29 with rounded forward edges 31. Since the difference between the diameter of the annular pressure surface 29 and that of the head of the bottle is less than the thickness of the stack of pressing-down disks 25, a prescribed force can, as will be described later herein with reference to FIG. 4, be exerted, ensuring optimal application of point 4.

At the end of insert structure 23 that faces pressing-down disks 25 is an insert 32 that has a pressure plate 33. Between pressure plate 33 and the pressing-down disk 25 that faces it is a thin and flexible intermediate shim 34 made out of a slippery material such as polytetrafluoroethylene. Retainer 27 and insert 32 with its pressure plate 33 are also made out of a slippery material such as polytetrafluoroethylene. Accommodation piece 22 is flexible enough to ensure pressure. Accommodation piece 22 and housing 21 have air-escape apertures 35 and 36.

The operation of the smoothing and pressing-down device illustrated in FIGS. 3 and 4 will now be explained.

When a bottle 3 enters the transfer star of the labeling machine with the point 4 of foil blank 2 standing out upstream, smoothing and pressing-down device 20 swings forward to above the bottle, with the point being wrapped flat against the face of the bottle if necessary by the smoothing and pressing-down device itself. Smoothing and pressing-down device 20 continues moving until its axis coincides with that of the bottle. With the bottle thus prepared, the device then drops down onto it. Spongy insert structure 23 is compressed and pressing-down disks 25 brought into the position illustrated in FIG. 4, creating a recess for the head of the bottle and ensuring satisfactory application of point 4 against it. Since the components or surfaces that come into contact with pressing-down disks 25 are made out of a slippery material such as polytetrafluoroethylene, friction and frictional heat will be very low and any heat will be carried away through air-escape apertures 35 and 36. The force that restores pressing-down disks 25 is exerted though insert 32 and pressure plate 33, with the empty axial and radial space between pressing-down disks 25 and retainer 27 ensuring satisfactorily rapid relaxation of the disks.

It is understood that the specification and examples are illustrative but not limitative of the present invention and that other embodiments within the spirit and scope of the invention will suggest themselves to those skilled in the art. Thus, multilayer pressing-down structure 24 does not have to consist of individual flat pressing-down disks 25 but can also be a composite with a thicker central sponge plate and accordingly thicker cover disks of resilient and flexible plastic. Furthermore, retainer 27 can of course be rapidly replaced to conform to bottles of different diameters.

It will be appreciated that the instant specification and claims are set forth by way of illustration and not limitation, and that various modifications and changes may be made without departing from the spirit and scope of the present invention.

What is claimed is:

1. In a device for a labeling machine, for smoothing and pressing down a point of a blank of foil wrapped around neck and head portions of a bottle with the point projecting at the head portion, the device having a pot-like housing with a pressing down structure connected thereto and which housing is axially movable into a pressing down position wherein the pressing down structure acts on the bottle head portion, the improvement wherein the pressing down structure comprises a first axially compressible upper component and a second multi-layer elastic component disposed below the first component and separated from the first component, and further comprising means coactive with the second component to form a recess in a face of the pressing-down structure toward the bottle that is configured to embrace at least the head portion of the bottle on all sides subject to slight tension on the head portion when the housing is in the pressing-down position wherein the multilayer elastic component consists of several separate flat pressing-down disks.

2. The device as in claim 1, wherein the means forming the recess comprises means mounting the pressing-down disks with axial and radial play in a retainer that has an aperture to admit the head portion of the bottle and an annular pressure surface with one of rounded and beveled forward edges.

3. The device as in claim 2, wherein the retainer is releasably fastened to the housing with a flexible piece.

4. The device as in claim 3 wherein the first component comprises an insert with a pressure plate fastened to the first component and disposed between the first component and the pressing-down disks.

5. The device as in claim 4, further comprising a thin and flexible intermediate shim made out of slippery material between the pressure plate on the insert and the pressing-down disk that faces the pressure plate.

6. The device as in claim 5, wherein the retainer and pressure plate are one of composed of and coated with a slippery material.

7. The device as in claim 6, further comprising air-escape apertures in the housing.

* * * * *

UNITED STATES PATENT AND TRADEMARK OFFICE

CERTIFICATE OF CORRECTION

PATENT NO. : 4,692,201

DATED : September 8, 1987

INVENTOR(S) : Rudolf Zodrow, et al.

It is certified that error appears in the above-identified patent and that said Letters Patent is hereby corrected as shown below:

| | |
|---|---|
| Title Page, under "Foreign Application Priority Data", line 1 | Delete "3417" and substitute --3417765-- |
| Col. 3, line 38 | Delete "aprture" and substitute --aperture-- |
| Col. 3, line 48 | Delete "170" and substitute --2/3-- |

Signed and Sealed this

Nineteenth Day of July, 1988

*Attest:*

DONALD J. QUIGG

*Attesting Officer*

*Commissioner of Patents and Trademarks*